United States Patent [19]

Lennon

[11] Patent Number: 5,074,355

[45] Date of Patent: Dec. 24, 1991

[54] SECTION MILL WITH MULTIPLE CUTTING BLADES

[75] Inventor: W. L. Lennon, Corsicana, Tex.

[73] Assignee: MASX Energy Services Group, Inc., Houston, Tex.

[21] Appl. No.: 566,023

[22] Filed: Aug. 10, 1990

[51] Int. Cl.[5] ..... E21B 10/66; E21B 29/00

[52] U.S. Cl. ..... 166/55.1; 166/55.3; 166/55.7; 166/297; 175/266

[58] Field of Search ..... 166/55.1, 297, 55.2, 166/55.3, 55.7, 55.8, 240; 175/258, 259, 266, 268, 273, 279

[56] References Cited

U.S. PATENT DOCUMENTS

| | | | |
|---|---|---|---|
| 1,747,513 | 2/1930 | Kammerdiner . | |
| 2,007,519 | 7/1935 | Church . | |
| 2,117,599 | 5/1938 | Bowen . | |
| 2,203,011 | 6/1940 | Ellis et al. . | |
| 2,373,006 | 4/1945 | Baker . | |
| 2,378,602 | 6/1945 | Waggener . | |
| 2,481,637 | 9/1949 | Yancey | 166/55.8 |
| 2,534,858 | 12/1950 | Ellis . | |
| 3,920,070 | 11/1975 | Goins | 166/55.8 |
| 4,003,433 | 1/1977 | Goins | 166/298 |
| 4,047,568 | 9/1977 | Aulenbacher | 166/298 |
| 4,625,799 | 12/1986 | McCormick et al. | 166/240 |
| 4,893,675 | 1/1990 | Skipper | 166/55.8 |

*Primary Examiner*—Terry L. Melius

*Attorney, Agent, or Firm*—Edgar A. Zarins; Malcolm L. Sutherland

[57] ABSTRACT

A section mill for cutting through well casing, the mill including multiple sets of cutting blades which are selectively engaged to continue cutting operations as blades dull. The cutting blade sets are selectively indexable such that as a first set dulls or fails a succeeding set can be utilized following retraction of the first set. The section mill includes a central mandrel having offset cammed surfaces which engage the cutting blades and cause them to expand outwardly. The mandrel is axially displaceably by a piston affected by hydraulic pressure. As the mandrel is axially displaced the indexed cutting blades are expanded by the cammed surface. Indexing is accomplished by a cam drum which allows the mandrel to be rotated relative to the cutting blades in order to align the next cammed surfaces with their respective cutting blades. The cam drum includes a continuous slot within which an indexing pin travels to control longitudinal and rotational displacement of the mandrel relative to the outer assembly which retains the cutting blades. In a preferred embodiment, the section mill includes three longitudinally spaced sets of cutting blades and camming surfaces which are relatively displaced 40°.

22 Claims, 2 Drawing Sheets

SECTION MILL WITH MULTIPLE CUTTING BLADES

BACKGROUND OF THE INVENTION

I. Field of the Invention

This invention relates to section mills for cutting through well casing by rotation of the tool and, in particular, to a section mill with multiple sets of cutting blades which are independently and successively engageable such that milling can continue without retrieving the tool as a set of cutting blades becomes non-functional.

II. Description of the Prior Art

A variety of cutting tools are utilized in the development and completion of wells, specifically to cut through or sever the well casing. Casing cutters may be used to form a transverse cut of the casing for removal of the well head or a section of the well casing. Milling tools are used to cut a hole through the casing for diverting the well bore or forming a horizontal bore. In most instances, the cutting tool is rotated to allow the cutting elements to cut through the casing. Obviously, the cutting elements will be dulled after prolonged cutting requiring replacement of the elements. If the severing or diversion operation has not been completed, the cutting tool must be retrieved from the hole to replace the cutting elements.

Typical prior known section mills include one set of cutter elements pivotably mounted within openings in the outer sleeve. The cutter elements engage an axially displaceable inner mandrel which is biased downwardly by a spring. The mandrel includes a sloped surface which moves beneath the cutter elements to force the elements radially outwardly as the mandrel is axially displaced against the force of the spring. The mandrel is displaced by hydraulic pressure. Fluid is pumped to the bottom end of the mandrel to force the mandrel upwardly within the outer sleeve in the nature of a piston within a cylinder. As hydraulic pressure is increased the cutting elements will be forced radially outwardly. Rotation of the tool will cause the cutting elements to cut against the casing. However, after a period of time the cutting elements will lose their ability to cut away the casing material particularly if thick casing is encountered. In such a situation the cutting tool must be retrieved from the hole to replace the cutting elements resulting in lost time and increased expense.

SUMMARY OF THE INVENTION

The present invention overcomes the disadvantages of the prior known cutting tools by providing multiple sets of cutting elements which can be successively engaged as a set of elements wears to completely cut through the casing in one trip of the tool.

The section mill according to the present invention generally comprises an outer sleeve with a plurality of windows to receive multiple sets of radially expandable cutting elements and an axially displaceable inner mandrel which selectively engages the cutting elements. The mandrel includes a piston at its lower end which sealingly cooperates with the outer sleeve to displace the mandrel as hydraulic pressure is applied to the piston. Formed on the periphery of the mandrel is a series of sloped surfaces which correspond to the number of sets of cutting elements. As the mandrel is longitudinally displaced a particular set of sloped surfaces will engage a set of cutting elements. A particular set of sloped surfaces is circumferentially offset from the other sets of sloped surfaces while the cutting elements are longitudinally aligned such that only one set of cutting elements will be engaged by sloped surfaces during axial displacement of the mandrel. Longitudinal and rotational movement of the mandrel is controlled by a cam drum on the mandrel which cooperates with a pin mounted in the sleeve. The pin moves through a continuous groove in the cam drum to limit the longitudinal and rotational movement. The continuous groove includes longitudinal components and diagonal components extending between opposite ends of the longitudinal components. Rotation of the mandrel such that the pin is positioned within the next longitudinal groove will align the next set of sloped surfaces with the corresponding cutting elements.

Other objects, features and advantages of the invention will be apparent from the following detailed description taken in connection with the accompanying drawings.

BRIEF DESCRIPTION OF THE DRAWINGS

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
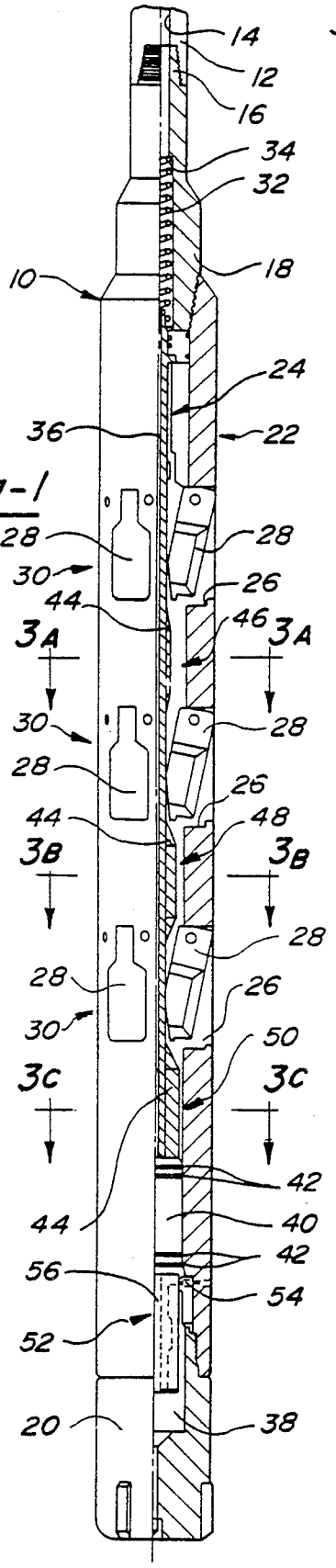
FIG. 1 is a partial cross-sectional perspective of the section mill embodying the present invention.

Referring first to FIG. 1, there is shown a section mill 10 embodying the present invention. The mill 10 is lowered into a well casing using a drill string 12 which is operatively connected to the upper end of the mill 10. The drill string 12 is also used to rotate the mill 10 for severing of the well casing as will be subsequently described. The drill string 12 includes an axial bore 14 for supplying an operating fluid to the mill 10. The drill string 12 is connected to a pin connector 16 of a top sub 18 of the section mill 10. The mill 10 also is provided with a stabilizer sub 20 at its downhole end to center and stabilize the section mill 10 during the cutting operation.

Figure 2:
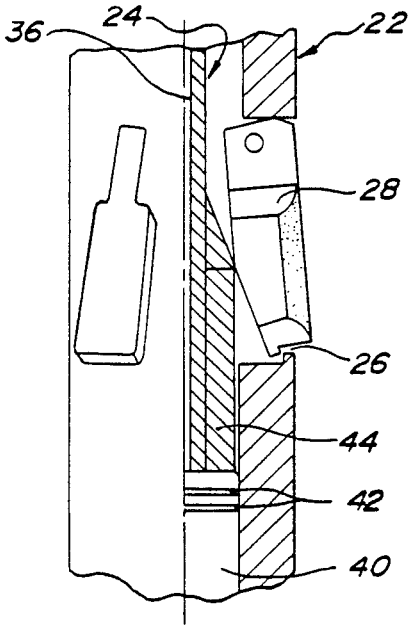
FIG. 2 is a partial cross-sectional perspective of a portion of the section mill of the present invention with the cutting elements radially expanded.

The section mill 10 generally comprises an outer sleeve 22 fixedly connected to the subs 18 and 20 and an inner mandrel 24 which is axially and rotatably movable within the sleeve 22 between the top sub 18 and the stabilizer sub 20. The outer sleeve or body 22 is threadably connected to the subs 18 and 20 and includes a plurality of windows or openings 26. Pivotably mounted within each of the openings 26 is a cutting element 28 for selective movement between a retracted position wherein the cutting element 28 is disposed completely within the sleeve 22 (FIg. 1) and an expanded position wherein the cutting element 28 is pivoted outwardly for engagement with the well casing (FIG. 2). The number of cutting elements 28 corresponds to the number of openings 26 in the outer sleeve 22. The cutting elements 28 are segregated into a plurality of cutting element sets 30 longitudinally spaced along the mill 10. Each of the cutting element sets 30 include a plurality of cutting elements 28 circumferentially spaced around the sleeve 22. In a preferred embodiment of the present invention, the section mill 10 includes three independently deployable cutting element sets 30 with each set 30 having three circumferentially spaced cutting elements 28. However, it is to be understood that the section mill 10 may be provided with a greater or fewer number of cutting element sets 30 with each set 30 having a greater or fewer number of cutting elements 28. Nevertheless, it has been found that the combination of three sets 20 each having three cutting elements 28 provides optimum operation of the mill 10. Preferably, the cutting elements 28 between the sets 20 are longitudinally aligned to facilitate independent deployment of the cutting element sets 30 as will be subsequently described.

The inner mandrel 24 is both rotatable and axially displaceable within the outer sleeve 33 in order to deploy individual sets 20 of cutting elements 28. The mandrel 24 is biased downwardly by a spring 32 seated between the upper end of the mandrel 24 and an annular shoulder 34 formed within the top sub 18. The mandrel 24 includes an axial fluid passageway 36 for supplying drilling fluid through the mandrel 24 to a cylinder chamber 38 formed in the lower end of the mill 10. The cylinder chamber 38 is sealingly separated from the rest of the sleeve 22 and the openings 26 to the well annulus by a piston 40 which forms a part of the mandrel 24. The piston 40 includes seal members 42 which sealingly engage the interior wall of the cylinder 38. Thus, as hydraulic pressure is increased within the cylinder chamber 38 the piston 40 and the mandrel 24 will be displaced upwardly against the force of the spring 32. As hydraulic pressure within the cylinder chamber 38 is decreased, the spring 32 will force the mandrel 24 axially downwardly.

Figure 3A:
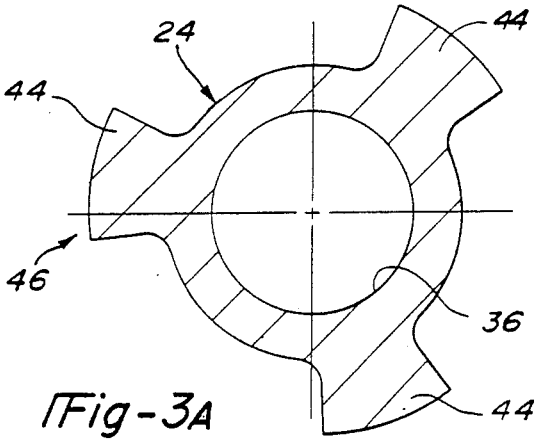
FIG. 3A is a transverse cross-sectional perspective of the inner mandrel taken along line 3A—3A of FIG. 1 showing the orientation of the mandrel.
Figure 3B:
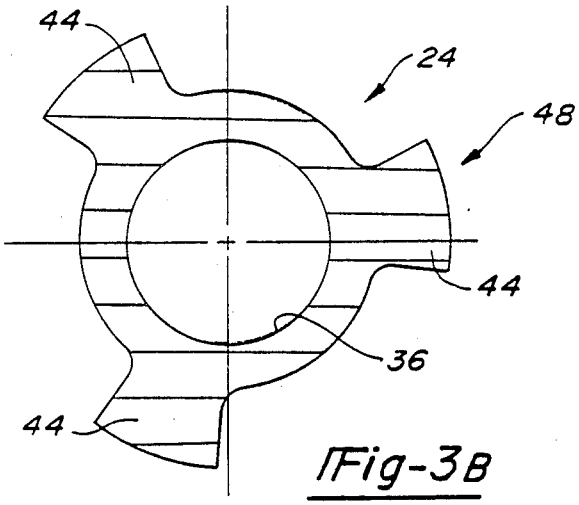
FIG. 3B is a transverse cross-sectional perspective of the inner mandrel taken along line 3B—3B of FIG. 1 showing the orientation of the mandrel.
Figure 3C:
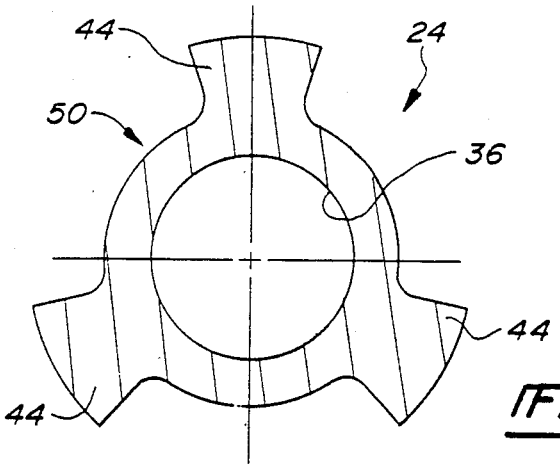
FIG. 3C is a transverse cross-sectional perspective of the inner mandrel taken along line 3C—3C of FIG. 1 showing the orientation of the mandrel.

Referring now to FIGS. 1 through 3, formed on the mandrel 24 are a series of sloped cam surfaces 44 adapted to selectively engage and expand the cutting elements 28. The number of cam surfaces 44 corresponds to the number of cutting elements 28. As with the cutting elements 28, the cam surfaces 44 are preferably longitudinally separated into a first cam surface set 46 (FIG. 3A), a second cam surface set 48 (FIG. 3B), and a third cam surface set 50 (FIG. 3C) with each set (46, 48, 50) having three circumferentially spaced cam surfaces 44. Thus, in the example of the present invention the cam surfaces 44 of any set (456, 48, 50) are spaced 120°. However, although the cam surfaces 44 are integrally formed with the mandrel 24, the cam surfaces 44 of any particular set (46, 48, 50) are circumferentially offset from the cam surfaces 44 of the longitudinally next cam surface set. In the preferred embodiment, the cam surfaces 44 are offset by 40°. Of course, the offset and spacing angles will vary depending upon the number of cam surfaces 44 and cutting elements 28. The cam surface sets (46, 48, 50) are offset such that only one set will engage the corresponding set 30 of cutting elements 44 as the mandrel 24 is axially displaced. Since the cutting elements are longitudinally aligned and the cam surfaces 44 are offset, longitudinal movement of the mandrel 24 will cause one set of cam surfaces 44 to move beneath the corresponding cutting element 28 to pivot it outwardly as shown in FIG. 2. The cam surfaces 44 of the other sets will pass alongside their respective cutting elements 28. Subsequent rotation of the mandrel 24 (by 40° in the example given) will cause a different, preferably the next adjacent, cam surface set to align with the respective cutting elements 28 for expansion of the elements 28.

Figure 4:
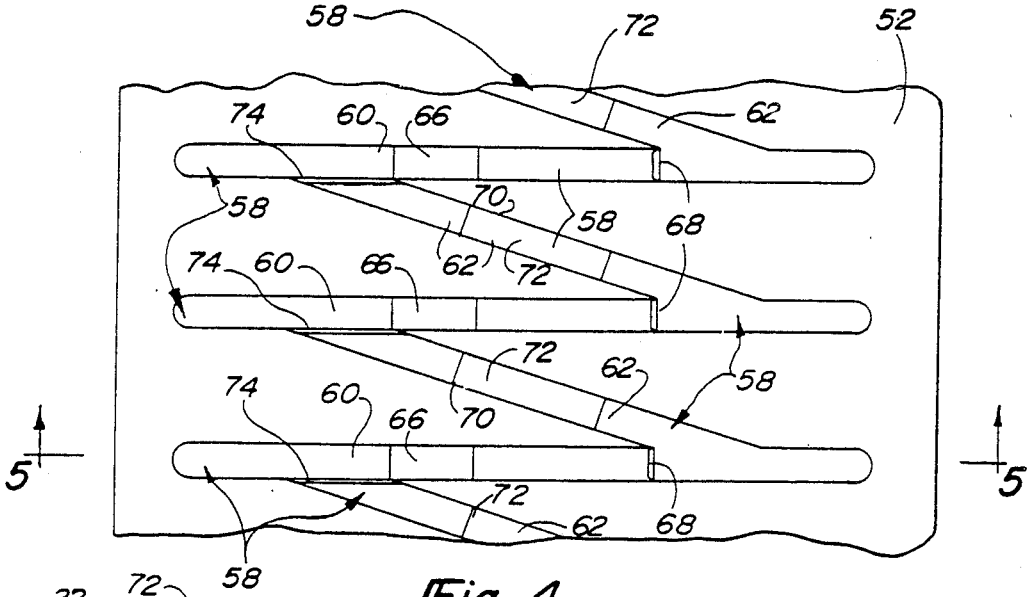
FIG. 4 is an unrolled view of the cam drum surface.
Figure 5:
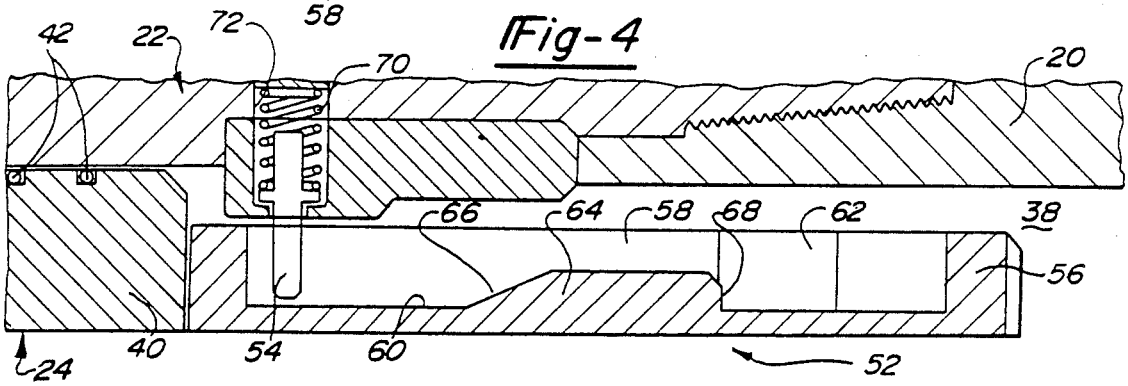
FIG. 5 is a cross-sectional perspective of the cam drum surface taken along line 5—5 of FIG. 4.

Referring now to FIGS. 4 and 5, axial and rotational displacement of the mandrel 24 is controlled by indexing means 52 which includes an indexing pin 54 and a cam drum 56. The cam drum 56 preferably forms a part of the mandrel 24 disposed below the piston 40 within the chamber 38. The cam drum 56 has a continuous groove 58 formed in the surface thereof and which receives the pin 54 such that movement of the mandrel 24 relative to the sleeve 22 is guided by the groove 58. The groove 58 is continuous around the circumference of the drum 56 and includes longitudinal components 60 and diagonal components 62 extending between opposite ends of the longitudinal components 60 of the groove 58. FIG. 4 illustrates an "unwrapped" depiction of the drum surface to show the relative positions of the groove components 60 and 62. The longitudinal components 60 of the groove 58 guide the axial displacement of the mandrel 24 within the sleeve 22 while preventing rotation thereof. The longitudinal components 60 are provided with camming blocks 64 which permit the mandrel 24 to be displaced longitudinally against the force of the spring 32 but not to be returned along the same longitudinal groove 60. The camming block 64 includes a first sloped surface 66 which causes the indexing pin 54 to ride up and over the camming block 64 as the mandrel 24 is axially displaced. As axial movement continues, the pin 54 will pass the shoulder 68 which thus prevents the pin 54 from travelling back along the longitudinal groove 60. The pin 54 is biased downwardly by a spring 70 to allow the pin 54 to retract and extend within bore 72. As the pin 54 engages the camming block 64, the pin 54 will be forced outwardly against the force of the spring 70. Once the pin 54 passes over the block 64 the spring 70 will cause the pin 54 to extend into the groove 58.

Once the pin 54 has travelled substantially the full length of the longitudinal groove 60, a specific set of cutting elements 28 will be fully expanded. In order to retract the expanded cutting elements 28 and align a next set of cam surfaces 44 with their respective cutting elements 28, the pin 54 must move through a diagonal component 62 to the next longitudinal component 60. The shoulder 68 will prevent the pin 54 from travelling back through the same groove 60 as the hydraulic pressure within the cylinder 38 is decreased allowing spring 32 to force the mandrel 24 downwardly. However, the pin 54 will travel along the diagonal component 62 to the next longitudinal component 60 causing the mandrel 24 to not only be axially displaced but also to rotate a predetermined distance. In a preferred embodiment, the mandrel 24 will rotate 40° so as to align the next set of cam surfaces 44 with their respective set of cutting elements 28. The diagonal component 62 also includes a camming block 70 to prevent the pin 54 from travelling in the wrong direction. The camming block 70 includes a first sloped surface 72 and a terminating shoulder 74.

Operation of the section mill 10 of the present invention permits the sequential implementation of multiple sets of cutting blades 28 to cut through a casing wall thereby eliminating the need to retrieve the mill 10 when the blades 28 become worn and the casing has not yet been severed. Once the tool is positioned, fluid can be pumped through the drill string 12 and the axial passageway 36 of the mandrel 24 to apply a hydraulic pressure to the piston 40. As the mandrel 24 is axially displaced the first set of cam surfaces 50 will move beneath the corresponding cutting elements 28 causing them to expand outwardly. Simultaneously, the tool is rotated to create the cutting action as the elements 28 expand. Continued displacement of the mandrel 24 will cause the pin 54 to move across camming block 64 within the longitudinal groove 60. In the event the blades 28 become dull and therefore inoperative, they can be retracted by reducing the hydraulic pressure within the chamber 38 allowing the spring 32 to bias the mandrel 24 downwardly. As this occurs, the pin 54 will travel through the diagonal component 62 of the groove 58 to rotate the mandrel 24. Once the pin 54 reaches the next longitudinal groove 60, the next set of cam surfaces 48 will become aligned with the cutting elements 28. After shifting the tool downwardly a predetermined distance to align this next set of elements 28 with the cut in the casing, the cutting elements 28 are again expanded for engagement with the casing by increasing the hydraulic pressure within the cylinder 38 to axially displace the mandrel 24. This operation can be continued with the third or subsequent sets of cutting elements 28 in the same manner until the well casing has been completely cut.

The foregoing detailed description has been given for clearness of understanding only and no unnecessary limitations should be understood therefrom as some modification will be obvious to those skilled in the art without departing from the scope and spirit of the appended claims.

I claim:

1. A rotatable section mill for cutting through a well casing comprising:

an outer sleeve having a plurality of openings circumferentially and longitudinally spaced apart along said sleeve;

a plurality of cutting element sets pivotably mounted within said openings of said outer sleeve for selective movement between a retracted position and an expanded position for engagement with the well casing, individual sets of cutting elements positioned within circumferentially spaced apart openings, said sets of cutting elements longitudinally spaced apart within said sleeve;

an inner mandrel axially displaceable within said outer sleeve, said mandrel including means for selectively expanding individual sets of cutting elements into engagement with the well casing independent of the other sets of cutting elements; and indexing means formed on said mandrel for controlling the displacement of said mandrel, said mandrel being rotatable and axially displaceable within said outer sleeve to selectively expand individual sets of cutting elements.

2. The mill as defined in claim 1 wherein said indexing means comprises a cam during a part of said mandrel and an indexing pin mounted to said sleeve for engagement with said cam drum, said cam drum including a continuous indexing groove receiving said indexing pin, said groove including longitudinal components to control the axial movement of said mandrel relative to said sleeve and diagonal components extending between said longitudinal components of said groove to control the rotational movement of said mandrel relative to said sleeve.

3. The mill as defined in claim 2 wherein each of said diagonal components and said longitudinal components of said continuous groove include a camming block which facilitates travel of said indexing pin through said groove in a first direction while preventing travel of said indexing pin through said groove in a second opposite direction, said indexing pin spring biased to allow said pin to move across said camming blocks.

4. The mill as defined in claim 2 wherein said mandrel includes a piston sealingly engaging said outer sleeve, said piston responsive to hydraulic pressure within said sleeve to axially displace said mandrel within said sleeve, said mandrel biased in a first longitudinal direction by a spring whereby an increase in hydraulic pressure against said piston will axially displace said mandrel against the force of said spring in a second direction and a reduction in hydraulic pressure against said piston will axially displace said mandrel in said first direction.

5. The mill as defined in claim 4 wherein said mandrel includes a plurality of cam surfaces corresponding to the number of cutting elements for selectively engaging and expanding said cutting elements into engagement with the well casing.

6. The mill as defined in claim 5 wherein said plurality of cam surfaces comprises a plurality of cam surface sets corresponding to said plurality of cutting element sets, said cam surface sets longitudinally spaced apart along said mandrel.

7. The mill as defined in claim 6 wherein each said cutting element set includes at least one cutting element for engagement with the well casing.

8. The mill as defined in claim 7 wherein each said cam surface set includes at least one surface corresponding to the number of cutting elements in each said cutting element set such that said cam surface set may be utilized to simultaneously expand said cutting elements of a corresponding cutting element set.

9. The mill as defined in claim 8 wherein said mandrel includes three sets of cam surfaces longitudinally spaced along said mandrel and said sleeve includes three sets of cutting elements correspondingly spaced along said sleeve.

10. The mill as defined in claim 9 wherein each set of cam surfaces include three cam surfaces circumferentially spaced on said mandrel and each set of cutting elements includes three cutting elements circumferentially spaced on said sleeve.

11. The mill as defined in claim 10 wherein said cam surfaces of each said set of cam surfaces are circumferentially spaced 120° on said mandrel and said cutting elements of each said set of cutting elements are circumferentially spaced 120° on said sleeve.

12. The mill as defined in claim 11 wherein said cutting elements of said cutting element sets are longitudinally aligned along said sleeve.

13. The mill as defined in claim 12 wherein said cam surface sets are circumferentially offset, each said cam surface set being circumferentially offset from the next said cam surface set by 40° whereby upon axial displacement of said mandrel in said second direction within said outer sleeve only one set of cam surfaces will engage and expand the corresponding set of cutting elements, said mandrel being indexably rotatable within said sleeve to align another set of cam surfaces to engage and expand the corresponding set of cutting elements.

14. The mill as defined in claim 4 wherein said mandrel includes an axial fluid passageway to supply hydraulic fluid downhole of said piston, said cam drum disposed downhole of said piston.

15. A rotatable section mill for cutting through a well casing comprising:

an outer sleeve having a plurality of openings circumferentially and longitudinally spaced apart along said sleeve;

a plurality of cutting element sets pivotably mounted within said openings of said outer sleeve for selective movement between a retracted position and an expanded position for engagement with the well casing, each set of cutting elements including three circumferentially spaced apart cutting elements positioned within circumferentially spaced openings, said sets of cutting elements longitudinally spaced apart along said sleeve;

an inner mandrel axially and rotatably displaceable within said outer sleeve, said mandrel including a plurality of cam surface sets corresponding to said plurality of cutting element sets, each set of cam surfaces including three cam surfaces circumferentially spaced on said mandrel, each set of cam surfaces on said mandrel independently and selectively engageable with the corresponding set of cutting elements for selectively expanding individual sets of cutting elements into engagement with the well casing independent of the other sets of cutting elements; and indexing means for controlling the axial and rotational movement of said mandrel within said sleeve whereby one set of cam surfaces is selectively aligned to engage the corresponding set of cutting elements and expand said set of cutting elements into engagement with the well casing.

16. The mill as defined in claim 15 wherein said mandrel includes a piston sealingly engaging said outer sleeve and forming a lower hydraulic cylinder, said piston responsive to hydraulic pressure within said cylinder to axially displace said mandrel within said sleeve, said mandrel biased in a first longitudinal direction by a spring whereby an increase in hydraulic pressure against said piston will axially displace said mandrel against the force of said spring in a second direction and a reduction in hydraulic pressure against said piston will axially displace said mandrel in said first direction.

17. The mill as defined in claim 16 wherein said mandrel includes an axial fluid passageway to supply fluid to said lower hydraulic cylinder.

18. The mill as defined in claim 16 wherein said indexing means comprises a cam drum forming a part of said mandrel and a spring-biased indexing pin mounted to said sleeve for engagement with said cam drum, said cam drum having a continuous indexing groove receiving said indexing pin formed in the outer surface of said drum, said groove including longitudinal components to guide the axial movement of said mandrel in said second direction relative to said sleeve and diagonal components extending between said longitudinal components to guide the rotational and first axial direction movement of said mandrel relative to said sleeve.

19. The mill as defined in claim 18 wherein said mandrel includes three sets of cam surfaces longitudinally spaced along said mandrel and said sleeve includes three sets of cutting elements correspondingly spaced along said sleeve.

20. The mill as defined in claim 19 wherein said cutting elements of said cutting element sets are longitudinally aligned along said sleeve.

21. The mill as defined in claim 20 wherein said cam surface sets are circumferentially offset, each said cam surface set being circumferentially offset from a next adjacent said cam surface st by 40° whereby upon axial displacement of said mandrel in said second direction within said outer sleeve only one set of cam surface will engage and expand the corresponding set of cutting elements, said mandrel being indexably rotatable within said sleeve to align a next adjacent set of cam surfaces to engage and expand the corresponding set of cutting elements.

22. A rotatable section mill for cutting through a well casing comprising:

an outer sleeve having a plurality of openings circumferentially and longitudinally spaced apart along said sleeve;

three sets of cutting elements pivotably mounted within said openings of said outer sleeve for selective movement between a retracted position and an expanded position for engagement with the well casing, each set of cutting elements including three circumferentially spaced apart cutting elements positioned within circumferentially spaced openings, said sets of cutting elements longitudinally spaced apart along said said sleeve;

an inner mandrel axially and rotatably displaceable within said outer sleeve, said mandrel including three longitudinally spaced sets of cam surfaces corresponding to said cutting element sets, each set of cam surfaces including three cam surfaces circumferentially space on said mandrel, each ser of cam surfaces on said mandrel independently and selectively engageable with the corresponding set of cutting elements for selectively expanding a single set of cutting elements into engagement with the well casing while maintaining the remaining cutting elements retracted; and indexing means for controlling the axial and rotational movement of said mandrel within said sleeve whereby one set of cam surfaces is selectively aligned to engage the corresponding set of cutting elements and expand said individual set of cutting elements into engagement with the well casing.

* * * * *